US006041473A

United States Patent [19]

Johnson

[11] Patent Number: 6,041,473

[45] Date of Patent: Mar. 28, 2000

[54] DOORSTOP SYSTEM WITH AN ANGLED LOWER FACE

[76] Inventor: Mike T. Johnson, 440 - 19th Street North, Lethbridge, Alberta, Canada, T1H 3K5

[21] Appl. No.: 09/088,017

[22] Filed: Jun. 1, 1998

[51] Int. Cl.[7] ..... E05F 5/02; E05C 17/54

[52] U.S. Cl. ..... 16/82; 16/DIG. 17; 292/343; D8/402

[58] Field of Search ..... 16/82, DIG. 17; D8/402, 47, 82, 90; 292/288, 342, 343; D25/113, 115, 118

[56] References Cited

U.S. PATENT DOCUMENTS

| | | | |
|---|---|---|---|
| D. 161,200 | 12/1950 | Phelps | D8/402 |
| D. 284,738 | 7/1986 | Stone | D8/402 |
| D. 323,778 | 2/1992 | Roman | D8/402 |
| 804,585 | 1/1905 | Depue | 292/343 |
| 3,054,632 | 9/1962 | Welch | 292/288 |
| 4,881,293 | 11/1989 | Reynolds | 16/86 A |
| 5,368,349 | 11/1994 | Hebert et al. | 292/343 |

FOREIGN PATENT DOCUMENTS

| | | | |
|---|---|---|---|
| 0250352A2 | 12/1987 | European Pat. Off. | 292/343 |

*Primary Examiner*—Anthony Knight
*Assistant Examiner*—Robert L. Pilaud

[57] ABSTRACT

A doorstop system with an angled lower face comprising a top face in a rectangular configuration with long side edges and short front and rear edges, two side faces in a generally triangular configuration, each side face having a lower horizontal edge, a short vertical front edge, and a large generally vertical rear edge and an angled upper edge. Included is a five-sided front face with a horizontal upper edge and short vertical side edges and two angled lower edges, one lower edge being longer than the other lower edge; a five-sided rear face with a horizontal upper edge and long vertical side edges and two angled lower edges, one lower edge being longer than the other lower edge. Finally, two bottom faces are provided, each bottom face being in a rectangular configuration, one being larger than the other.

4 Claims, 2 Drawing Sheets

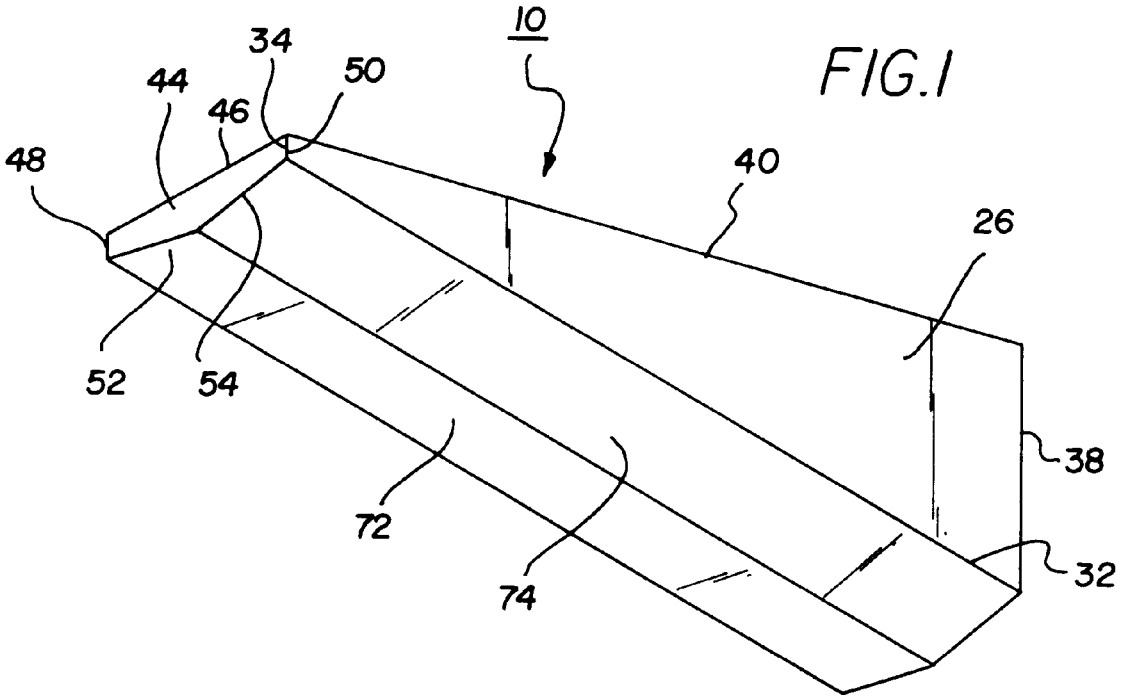
FIG.1
FIG.2
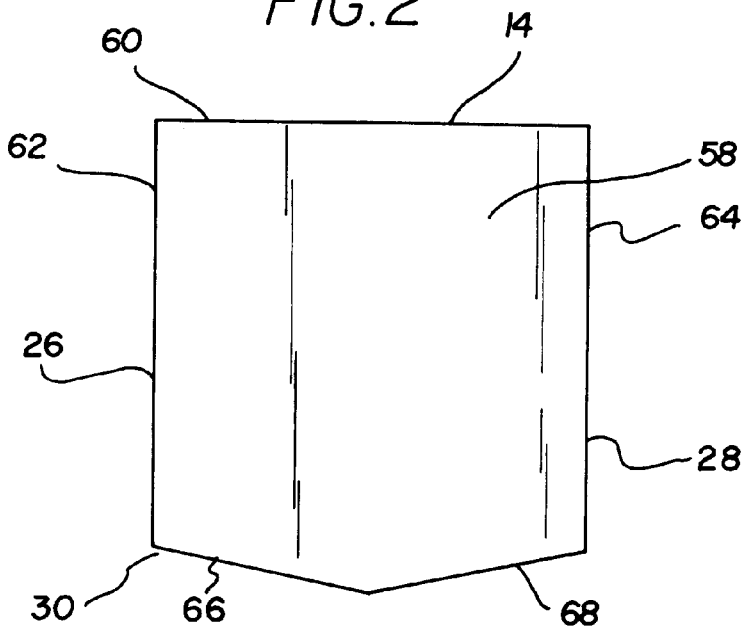

DOORSTOP SYSTEM WITH AN ANGLED LOWER FACE

BACKGROUND OF THE INVENTION

1. Field of the Invention

The present invention relates to a new and improved doorstop system with an angled lower face and, more particularly, pertains to maintaining a door at a pre-selected position of openness.

2. Description of the Prior Art

The use of doorstops of known designs and configurations is known in the prior art. More specifically, doorstops of known designs and configurations heretofore devised and utilized for the purpose of maintaining doors open by known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for maintaining a door at a pre-selected position of openness. Examples of prior art devices disclosing a wedge shape or other geometric door stop design include, for example, U.S. Pat. No. 4,881,293 to Reynolds, issue/priority Nov. 21, 1989;

U.S. Pat. No. 804,585 to Depue, issue/priority Nov. 14, 1905; U.S. Pat. No. 3,054,632 to Welch, issue/priority Sep. 18, 1962;

U.S. Pat. No. 5,368,349 to Hebert et al., issue/priority Nov. 29, 1994; U.S. Pat. No. Des. 323,778 to Roman, issue/priority Feb. 11, 1992; and Foreign patents WO 95/06, 796 to Hebert et al., issue/priority Mar. 9, 1995 and EP 0 250 352 A2 to Bosch, issue/priority Jun. 17, 1987.

In this respect, the doorstop system with an angled lower face according to the present invention substantially departs from the conventional concepts and designs of the prior art, and in doing so provides an apparatus primarily developed for the purpose of maintaining a door at a pre-selected position of openness.

Therefore, it can be appreciated that there exists a continuing need for a new and improved doorstop system with an angled lower face which can be used for maintaining a door at a pre-selected position of openness. In this regard, the present invention substantially fulfills this need.

SUMMARY OF THE INVENTION

In view of the foregoing disadvantages inherent in the known types of doorstops of known designs and configurations now present in the prior art, the present invention provides an improved doorstop system with an angled lower face. As such, the general purpose of the present invention, which will be described subsequently in greater detail, is to provide a new and improved doorstop system with an angled lower face and methods which have all the advantages of the prior art and none of the disadvantages.

To attain this, the present invention essentially comprises a new and improved doorstop system with an angled lower face. The doorstop system has a top face in a rectangular configuration with long side edges and short front and rear edges. Also, there are two side faces in a generally triangular configuration, each side face having a lower horizontal edge, a short vertical front edge, and a large generally vertical rear edge and an angled upper edge. Included is a five-sided front face with a horizontal upper edge and long vertical side edges and two angled lower edges, one lower edge being longer than the other lower edge. Provided is a five-sided rear face with a horizontal upper edge and short vertical side edges and two angled lower edges, one lower edge being longer than the other lower edge. Two bottom faces are shown, each bottom face being in a rectangular configuration, one being larger than the other, with one bottom face being at an angle of about ten degrees with respect to the upper edge of the front and rear faces and the other bottom face being at an angle of about twenty degrees with respect to the upper edge of the front and rear faces. Finally, the entire doorstop having a height of about 1 and ¾ inch and a length of about 8 inches.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved doorstop system with an angled lower face which has all the advantages of the prior art doorstops of known designs and configurations and none of the disadvantages.

It is another object of the present invention to provide a new and improved doorstop system with an angled lower face which may be easily and efficiently manufactured and marketed.

It is a further object of the present invention to provide a new and improved doorstop system with an angled lower face which is of a durable and reliable construction.

An even further object of the present invention is to provide a new and improved doorstop system with an angled lower face which is susceptible of a low cost of manufacture with regard to both materials and labor, and which accordingly is then susceptible of low prices of sale to the consuming public, thereby making such doorstops of known designs and configurations economically available to the buying public.

Still yet another object of the present invention is to provide a new and improved doorstop system with an angled lower face which provides in the apparatuses and methods of the prior art some of the advantages thereof, while simultaneously overcoming some of the disadvantages normally associated therewith.

Even still another object of the present invention is to maintain a door at a pre-selected position of openness.

Lastly, it is an object of the present invention to provide a doorstop system with an angled lower face comprising a top face in a rectangular configuration with long side edges and short front and rear edges, two side faces in a generally triangular configuration, each side face having a lower horizontal edge, a short vertical front edge, and a large generally vertical rear edge and an angled upper edge. Included is a five-sided front face with a horizontal upper edge and long vertical side edges and two angled lower edges, one lower edge being longer than the other lower edge and a five-sided rear face with a horizontal upper edge and short vertical side edges and two angled lower edges, one lower edge being longer than the other lower edge. Finally, two bottom faces are shown, each bottom face being in a rectangular configuration, one being larger than the other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the doorstop system with an angled lower face constructed in accordance with the principles of the present invention.

FIG. 2 is a rear elevational view of the device shown in FIG. 1.

The same reference numerals refer to the same parts throughout the various Figures.

DESCRIPTION OF THE PREFERRED EMBODIMENT

Figure 3:
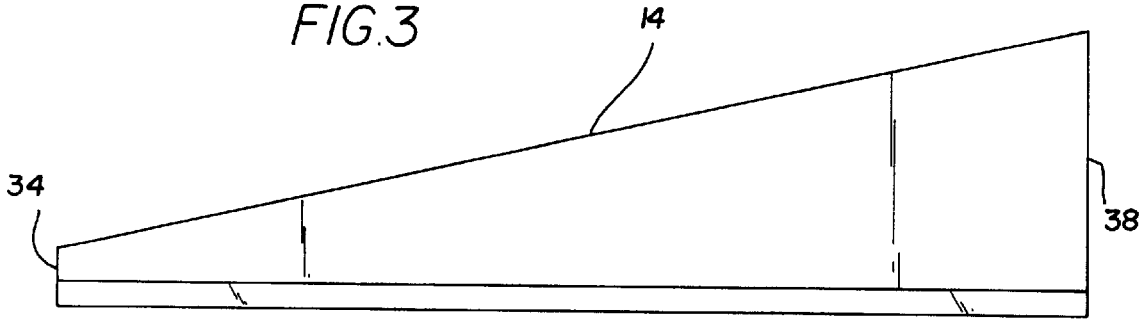
FIG. 3 is a side elevational view of the device shown in the prior figures.
Figure 4:
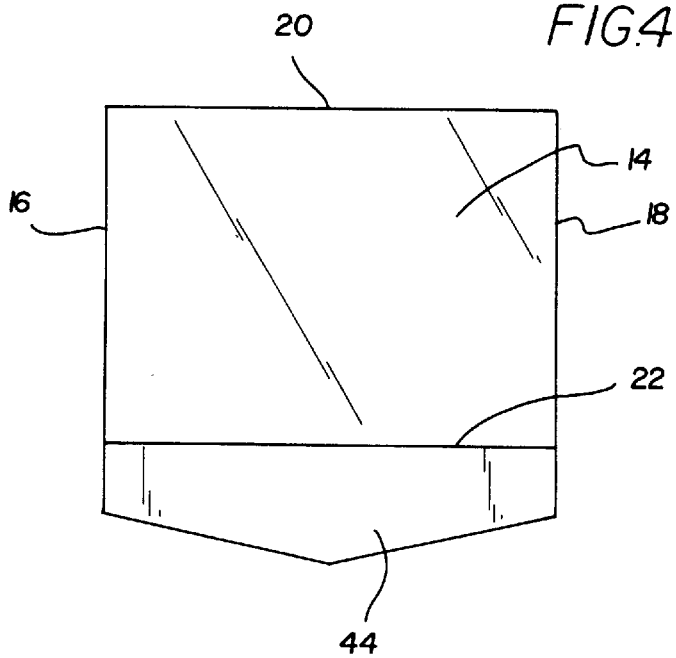
FIG. 4 is a rear elevational view of the device shown in the prior figures.

With reference now to the drawings, and in particular to FIG. 1 thereof, the preferred embodiment of the new and improved doorstop system with an angled lower face embodying the principles and concepts of the present invention and generally designated by the reference numeral 10 will be described.

The present invention, the new and improved doorstop system with an angled lower face, is a system 10 comprised of a plurality of components. In their broadest context, the components include a top face, two side faces, a front face, a rear face and two bottom faces. Each of the individual components is specifically configured and correlated one with respect to the other so as to attain the desired objectives.

More specifically, the system 10 of the present invention includes a top face 14 in a rectangular configuration. The top face has long side edges 16, 18 and short front and rear edges 20,22. The system also includes two side faces 26,28 in a generally triangular configuration. Each side face has a lower horizontal edge 30,32, a short vertical front edge 34, and a large generally vertical rear edge 38 and an angled upper edge 40. A five-sided front face 44 is provided. The front face has a horizontal upper edge 46 and short vertical side edges 48,50 and two angled lower edges 52,54. One lower edge is longer than the other lower edge.

Next provided is a five-sided rear face 58 with a horizontal upper edge 60 and long vertical side edges 62,64 and two angled lower edges 66,68, one lower edge being longer than the other lower edge.

Lastly provided are two bottom faces, 72,74. Each bottom face is in a rectangular configuration, one being larger than the other, with one bottom face 72 being at an angle of about ten degrees with respect to the upper edge of the front and rear faces and the other bottom face 74 being at an angle of about twenty degrees with respect to the upper edge of the front and rear faces.

The entire doorstop has a height of about 1 and ¾ inch and a length of about 8 inches.

This double wedge, two-way doorstop is a specialized door stop measuring 8 inches long, 1 and ¾ inches high on the large end and ⅝ inch high on the small end. Two angled wedges cut into the length of the stop to form a sharp point measure 10 to 20 degrees. The action of a door closing will push on the stop which has been placed beneath it at an angle. The motion causes the door stop to roll. However, the angled design of the second wedge then pushes the door upwards, causing the door to remain securely propped open.

Various versions of the wedge would be needed, as the present invention must be designed based upon individual measurements, for example, the distance between the floor and the door's bottom edge. The surface of the floor is also important, for example, whether it is smooth or rough. In short, the present invention should be produced in various sizes for different gaps, and in different materials based upon whether the floor is wood, cement, carpet or the like. This clever door stop must be placed beneath the door at an angle for the "rolling" action to occur.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. A doorstop system with an angled lower face comprising:

a top face in a rectangular configuration with long side edges and short front and rear edges;

two side faces in a generally triangular configuration, each side face having a lower horizontal edge, a short vertical front edge, and a large generally vertical rear edge and an angled upper edge coupling the short vertical front edge to the large generally vertical rear edge;

a five-sided front face with a horizontal upper edge and short vertical side edges and two angled lower edges, one lower edge being longer than the other lower edge;

a five-sided rear face with a horizontal upper edge and short vertical side edges and two angled lower edges, one lower edge being longer than the other lower edge;

two bottom faces, each bottom face being in a rectangular configuration, one being larger than the other, with one bottom face being at an angle of about ten degrees with respect to the upper edge of the front and rear faces and the other bottom face being at an angle of about twenty degrees with respect to the upper edge of the front and rear faces; and the entire doorstop having a height of about 1 and ¾ inch and a length of about 8 inches.

2. A doorstop system with an angled lower face comprising:

a top face in a rectangular configuration with long side edges and short front and rear edges;

two side faces in a generally triangular configuration, each side face having a lower horizontal edge, a short vertical front edge, and a large generally vertical rear edge and an angled upper edge coupling the short vertical front edge to the large generally vertical rear edge;

a five-sided front face with a horizontal upper edge and short vertical side edges and two angled lower edges, one lower edge being longer than the other lower edge;

a five-sided rear face with a horizontal upper edge and short vertical side edges and two angled lower edges, one lower edge being longer than the other lower edge; and two bottom faces, each bottom face being in a rectangular configuration, one being larger than the other.

3. The doorstop system with an angled lower face as set forth in claim 2 and further including the entire doorstop having a height of about 1 and ¾ inch and a length of about 8 inches.

4. The doorstop system with an angled lower face as set forth in claim 2 and further including one bottom face being at an angle of about ten degrees with respect to the upper edge of the other bottom face being at an angle of about twenty degrees with respect to the upper edge of the front and rear faces.

* * * * *